US005419174A

United States Patent [19]

Waggoner

[11] Patent Number: 5,419,174

[45] Date of Patent: May 30, 1995

[54] APPARATUS FOR FORMING TUBULAR RISERS AND MANIFOLDS INCLUDING TUBULAR RISERS

[75] Inventor: John P. Waggoner, Decatur, Ind.

[73] Assignee: Amcast Industrial Corporation, Dayton, Ohio

[21] Appl. No.: 228,890

[22] Filed: Apr. 18, 1994

Related U.S. Application Data

[62] Division of Ser. No. 95,099, Jul. 21, 1993, Pat. No. 5,337,477.

[51] Int. Cl.[6] ..... B21D 53/06

[52] U.S. Cl. ..... 72/352; 72/370; 29/890.052

[58] Field of Search ..... 29/557, 727, 890.033, 29/890.052, 890.053; 72/254, 264, 347, 352, 370, 467

[56] References Cited

U.S. PATENT DOCUMENTS

| | | |
|---|---|---|
| 633,280 | 9/1899 | Blakeslee . |
| 1,946,117 | 2/1934 | Sparks . |
| 2,224,670 | 12/1940 | Criley . |
| 2,950,817 | 8/1960 | Graham . |
| 3,108,362 | 10/1963 | Huet . |
| 3,134,422 | 5/1964 | Granberg . |
| 3,750,450 | 8/1973 | Sharp et al. . |
| 4,234,041 | 11/1980 | Melnyk . |
| 4,291,566 | 9/1981 | Dinsdale . |
| 4,367,643 | 1/1983 | Hackett . |
| 4,512,069 | 4/1985 | Hagemeister . |
| 4,663,812 | 5/1987 | Clausen . |
| 4,749,033 | 6/1988 | Clausen . |
| 4,769,907 | 9/1988 | Sebastien . |
| 4,770,248 | 9/1988 | Dawson et al. . |
| 5,088,193 | 2/1992 | Okada et al. . |

FOREIGN PATENT DOCUMENTS

| | | | |
|---|---|---|---|
| 1159886 | 7/1958 | France . | |
| 2229558 | 1/1973 | Germany | 72/352 |
| 57-28632 | 2/1982 | Japan | 72/352 |
| 609568 | 5/1978 | U.S.S.R. . | |
| 795610 | 1/1981 | U.S.S.R. . | |

*Primary Examiner*—Tom Hughes
*Attorney, Agent, or Firm*—Killworth, Gottman, Hagan & Schaeff

[57] ABSTRACT

A manifold for a heat exchanger is formed by placing a blank having a siamesed pair of tubular passages supported by a first mandrel into a die cavity which receives the blank and defines at least one riser channel extending from the cavity. Each riser channel includes a core such that when a punch forces the blank into the die cavity, the blank is formed as desired and a portion of the blank is forged into the riser channel and around the core. The portion of the sidewall of the blank adjacent to the tubular risers is thickened such that the sidewall of the resulting manifold is substantially uniform after forging. After forging, the blank is removed from the die and the first mandrel is removed. The manifold is completed by inserting a second mandrel including holes in substantial alignment with the tubular risers and forcing punches into the tubular risers to remove the remaining material which separates the risers from the passages. The cores include sharp forming edges between terminal end surfaces and forming surfaces extending around the cores to define the forming heads. Recesses, depressions, patterns of grooves or the like are formed in the end surfaces of the cores. The cores include forming heads with the remainder of the cores and/or riser channels being relieved to facilitate removal of the risers from the riser channels. The riser channels and/or cores can be shaped to form defined distal ends on the tubular risers.

6 Claims, 3 Drawing Sheets

APPARATUS FOR FORMING TUBULAR RISERS AND MANIFOLDS INCLUDING TUBULAR RISERS

This is a division of application Ser. No. 08/095,099 filed Jul. 21, 1993, now U.S. Pat. No. 5,337,477.

BACKGROUND OF THE INVENTION

The present invention relates in general to forming aluminum, copper or other ductile metals and, more particularly, to methods and apparatus for forming one or more risers on a blank of such material to form, for example, a manifold for a heat exchanger. In an initial application of the present invention for forming a manifold for an automotive air conditioner condenser, the blank includes a siamesed pair of tubular passages to each of which a plurality of tubular risers are formed.

A common form of heat exchanger used for automotive, residential and commercial heating and cooling applications is formed by connecting a number of generally U-shaped tubes to a header plate or manifold. The manifold typically comprises one or two hollow passages with a series of individual tubular risers extending from and being in communication with the passage or passages. The U-shaped tubes are then connected to the manifold by means of the tubular risers.

Numerous arrangements have been used to form manifolds for the manufacture of such heat exchangers. One recent example, U.S. Pat. No. 4,663,812, discloses extruding or drawing a tube with an integral rib formed on one side of the tube. The rib is formed into a plurality of cylindrical solid risers by machining or cold forming with cold forming taking place after insertion of a supporting mandrel or cylinder into the tube. The solid risers are converted to hollow risers by an impact extrusion process. Apertures are then formed under the hollow risers by operation of a cutting or perforating tool on the open tube.

Another later example, U.S. Pat. No. 5,190,101, discloses a heat exchanger manifold made from a one piece aluminum extrusion. The extrusion is a U-shaped channel. The manifold is formed by piercing a plurality of apertures or extruding a plurality of tubular members in a base member of the channel to form fluid conducting passageways therethrough. Up-standing walls of the channel and then rolled toward the center of the base member to form a pair of hollow fluid conduits which are in communication with their respective fluid conducting passageways. A weld seam or braze joint is then formed along the length of the manifold.

A review of these exemplary arrangements shows that several processing steps are necessary for fabrication of manifolds for heat exchangers in accordance with their teachings. Many other earlier arrangements required even more, some substantially more, processing steps. Since manufacturing efficiency, and accordingly expense, are greatly impacted by the number of steps which must be performed to fabricate a manifold, there is an ongoing need to develop manufacturing arrangements which require fewer or more simplified steps. Preferably, these arrangements could also be applied to other applications and forms of manifolds. For example, it would be desirable to be able to efficiently form tubular risers for solid header plates for manifolds using such header plates.

SUMMARY OF THE INVENTION

This ongoing need is currently answered by the methods and apparatus of the present invention wherein a blank is positioned into a die cavity which receives the blank and defines at least one riser channel extending from the cavity. Each riser channel includes a core positioned therein such that when a punch forces the blank into the die cavity, the blank is formed as desired and a portion of the blank is forged into the riser channel and around the core. The core can also be driven within the riser channel if desired or required for a given application.

For the formation of a manifold, the blank defines at least one tubular passage which is supported by having a mandrel inserted therein for the forging operation. In an illustrated form of the invention, the blank includes a siamesed pair of tubular passages which are received within a die cavity. The blank can be configured to generally correspond to the die cavity or the blank can be formed as desired during the forming operation. A plurality of hollow risers are formed onto the blank extending generally laterally from and in alignment with the tubular passages of the blank.

The portion of the sidewall of the blank adjacent to the tubular risers is preferably formed to be thicker such that the sidewall of the resulting manifold is substantially uniform after metal is forged from the thickened sidewall portion to form the hollow tubular risers on the manifold. Once the tubular risers are forged, the blank is removed from the die and the corresponding mandrel is removed from the tubular passages of the blank. The manifold is then completed by inserting a second mandrel which includes holes in substantial alignment with the tubular risers. The tubular risers are then placed in communication with the tubular passages of the original blank by forcing punches into the tubular risers to remove the remaining material which separates the risers from the passages.

The cores used to form the tubular risers preferably include sharp forming edges between terminal end surfaces of the cores and forming surfaces extending around the cores to define the forming heads. The sharp forming edges have been found to improve wall uniformity in the tubular risers. Riser wall uniformity is further improved by stabilizing the material immediately ahead of the cores by forming recesses, depressions, patterns of grooves or the like in the end surfaces of the cores.

Preferably, the cores include forming heads with the remainder of the cores and/or riser channels being relieved to facilitate removal of the risers from the riser channels. The riser channels and/or cores can be shaped to form defined distal ends on the tubular risers. For example, a conical indentation can be formed on the distal ends of the risers to facilitate insertion of tubes into the risers or the risers into tubes to form-a heat exchanger.

In accordance with one aspect of the present invention, a method for making a manifold having at least one primary tubular member and at least one tubular riser extending laterally therefrom comprises the steps of: inserting corresponding first mandrel means into the at least one primary tubular member for supporting the at least one primary tubular member; positioning the at least one primary tubular member with the first mandrel means therein into a die defining a cavity having a primary channel for receiving the at least one primary tubular member and at least one riser channel extending laterally from the primary channel; positioning a core in the at least one riser channel; forcing a punch into the cavity to forge a portion of the primary tubular member into the at least one riser channel and around the core to thereby form at least one tubular riser; removing the punch from the cavity; removing the manifold from the cavity; and removing the first mandrel means from the at least one primary tubular member.

For completion of the manifold, the method may further comprise the steps of: inserting corresponding second mandrel means into the at least one primary tubular member, the second mandrel means having at least one hole formed therein which is substantially aligned with the at least one tubular riser when inserted into the at least one primary tubular member; and forcing corresponding punch means into the at least one tubular riser to place the tubular riser into communication with the at least one primary tubular member. To achieve a substantially uniform sidewall in the completed manifold, the method may further comprise the step of forming a portion of a sidewall of the primary tubular member adjacent to the at least one riser channel to be thicker than the remainder of the sidewall.

In accordance with another aspect of the present invention, a method for making a manifold comprising a primary member having at least one tubular passage formed therethrough and at least one tubular riser extending laterally from the at least one tubular passage comprises the steps of: preforming a manifold blank having at least one tubular passage therethrough; supporting the at least one tubular passage of the manifold blank by corresponding first mandrel means inserted therein; positioning the manifold blank into a die cavity having a primary channel adapted to receive and convert the manifold blank into the manifold, the die cavity defining at least one riser channel extending laterally from the primary channel; positioning a core in each of the at least one riser channel; forcing a punch into the cavity, the punch being adapted to engage and convert the manifold blank into the manifold by forging a portion of the manifold blank into the at least one riser channel and around the core to thereby format least one tubular riser; removing the punch from the cavity; removing the manifold from the cavity; and removing the corresponding first mandrel means.

For completion of the manifold, the method may further comprise the steps of: supporting the at least one tubular passage of the manifold blank by corresponding second mandrel means inserted therein, the second mandrel means having at least one hole formed therein which is substantially aligned with the at least one tubular riser; and forcing corresponding punch means into the at least one tubular riser to communicate the at least one tubular riser with the at least one tubular passage. To achieve a substantially uniform sidewall in the completed manifold, the method may further comprise the step of thickening a sidewall portion of the manifold blank adjacent to the at least one riser channel.

To assist in utilization of the manifold, the method may further comprise the step of providing means for forming a defined distal end on the at least one tubular riser. A core may be forced into each riser channel to help the flow of the blank material over the core or the step of positioning a core in the at least one riser channel may comprise fixedly positioning a core in each riser channel. Preferably, the method further comprises the step of forming each core to have a sharp forming edge at its distal end and may further comprise the step of forming each core to have an indentation in its distal end.

In accordance with still another aspect of the present invention, apparatus for forming at least one tubular riser on a blank comprises a die defining a cavity having a first portion for receiving the blank and at least one riser channel extending from the first portion. Core means are positioned within the riser channel for forming a hollow within the tubular riser. The core means has a forming head on its distal end with relief means extending along the core means beyond the forming head. A punch is received within the cavity for forging a portion of the blank into the at least one riser channel and around the core means to form the at least one tubular riser on the blank. The forming head preferably includes a sharp forming edge between a terminal end surface thereof and a forming surface which extends around the head. Further, the forming head includes a terminal surface having an indentation therein. The relief means may comprise an enlarged extension of the riser channel extending along at least a portion of the riser channel from the forming head of the core means toward a proximal end of the core means; a stepped down portion of the core means extending from the forming head toward a proximal end of the core means; or both.

In accordance with yet another aspect of the present invention, a punch for forming ductile metals comprises a punch body having a distal forming end which defines a sharp forming edge between a terminal end surface thereof and a forming surface extending therearound. Preferably, the terminal end surface of the distal forming end of the punch body includes an indentation therein.

It is thus an object of the present invention to provide improved methods and apparatus for forming tubular risers and manifolds including tubular risers; to provide improved methods and apparatus for forming tubular risers and manifolds including tubular risers wherein a blank is forged in a die cavity to form tubular risers around cores which are positioned in riser channels extending from the cavity; to provide improved methods and apparatus for forming tubular risers and manifolds including tubular risers wherein riser forming cores have forming heads defining sharp forming edges; and, to provide improved methods and apparatus for forming tubular risers and manifolds including tubular risers wherein riser forming cores have forming heads having end faces with indentations formed therein.

Other objects and advantages of the invention will be apparent from the following description, the accompanying drawings and the appended claims.

DETAILED DESCRIPTION OF THE INVENTION

Figure 1:
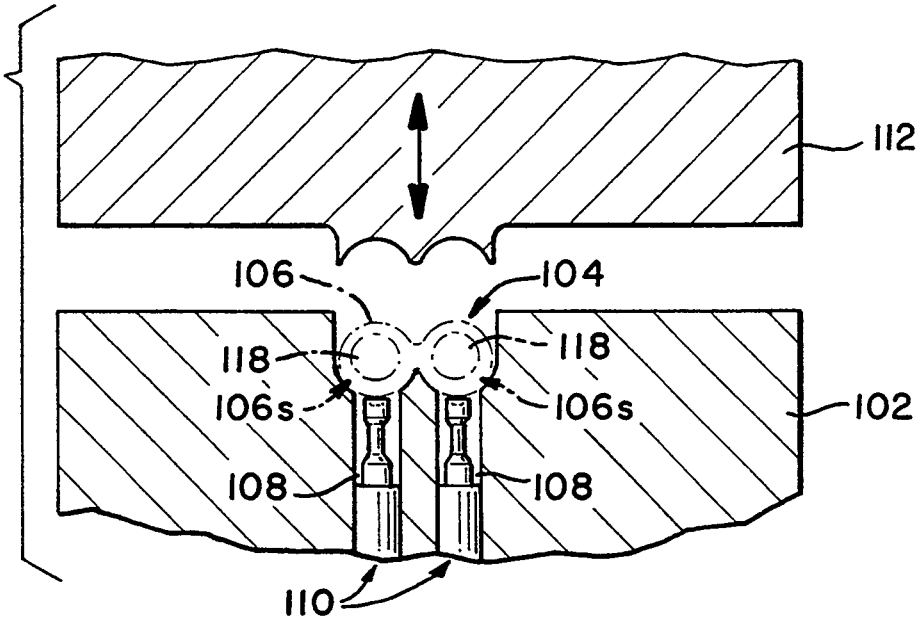
FIG. 1 is a schematic cross-sectional view of a die, punch and cores operable in accordance with the present invention.

The invention of the present application will now be described with reference to the drawing figures which illustrate formation of a manifold for an automotive air conditioner condenser from a blank including a siamesed pair of tubular passages to each of which a plurality of tubular risers are formed. It is to be understood that the present invention is generally applicable; however, it will be described with reference to the manifold which is an initial application of the invention.

Figure 2:
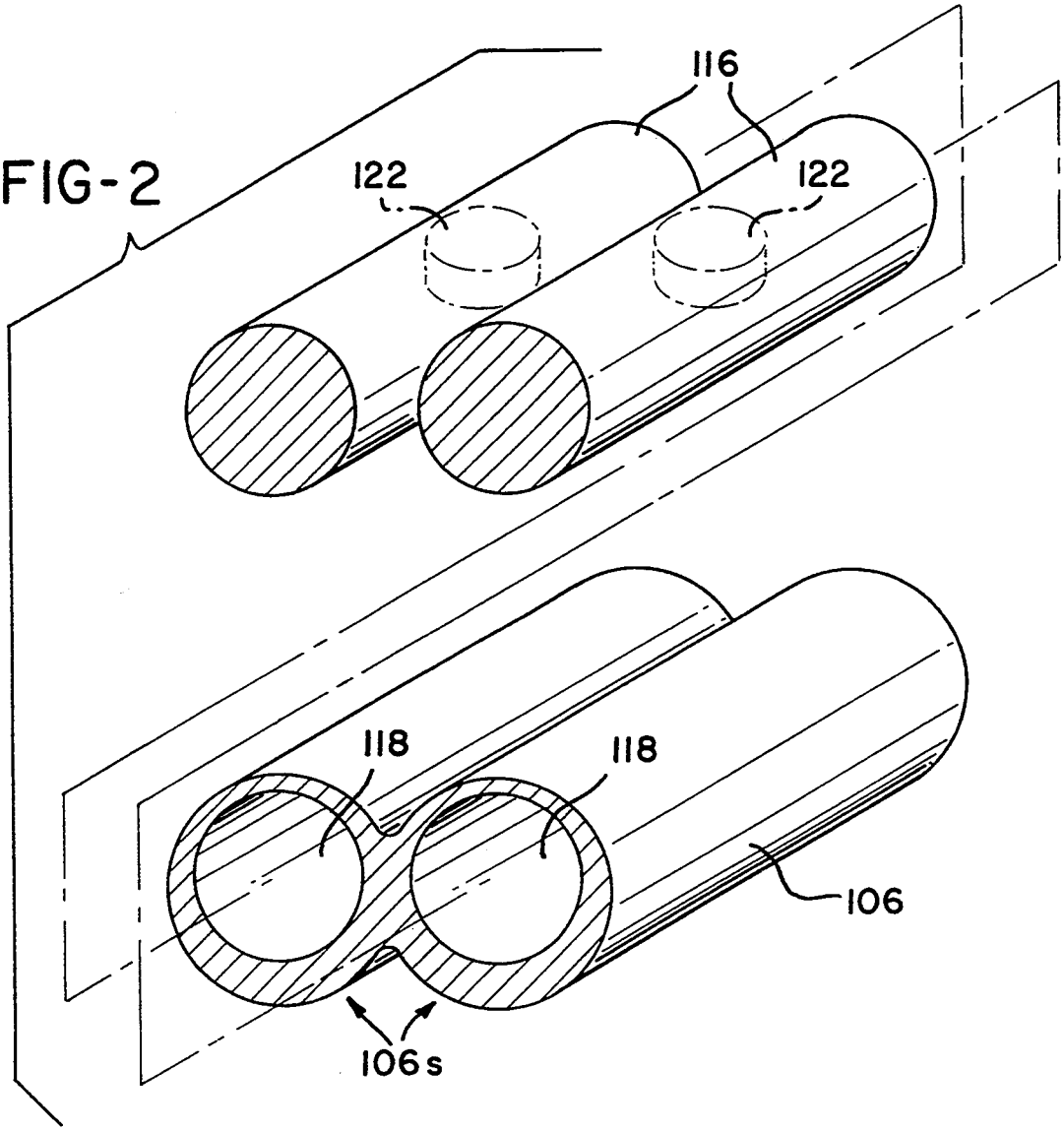
FIG. 2 is a perspective view illustrating a short section of manifold blank and associated mandrels used in processing the blank into a manifold in accordance with the present invention.

In FIG. 1, a die 102 defines a cavity 104 defining a primary channel for receiving a manifold blank 106 which is best illustrated in FIG. 2 by a short section of the manifold blank 106. As is apparent, the illustrated blank 106 is shaped to generally conform to the primary channel of the cavity 104. It is noted that blanks of other shapes which do not conform to the cavity 104 but are shaped thereby can be used in the present invention. Riser channels 108 extend laterally from the cavity 104. Cores 110 are fixedly positioned in the riser channel 108 in the illustrated embodiment of the invention. In some applications it may be desirable to force the cores 110 into the riser channels 108 to facilitate the metal flow process around the cores as will become apparent.

A punch 112 is forced into the cavity 104 of the die 102 to forge portions of the blank 106 into the riser channels 108 and around the cores 110 to form tubular risers 114. Prior to forcing the punch 112 into the cavity 104, first mandrel means comprising a pair of solid, hardened mandrels 116 are inserted into tubular passages 118 of the blank 106. Preferably, the mandrels 116 are connected to one another to facilitate their insertion and removal from the passages 118.

Figure 5:
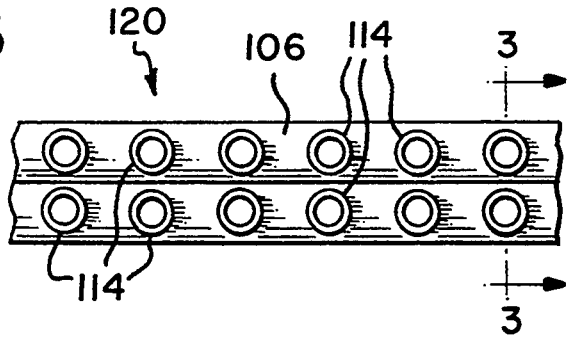
FIGS. 5 and 6 are top and side views, respectively, of a short section of a manifold made in accordance with the present invention.
Figure 6:
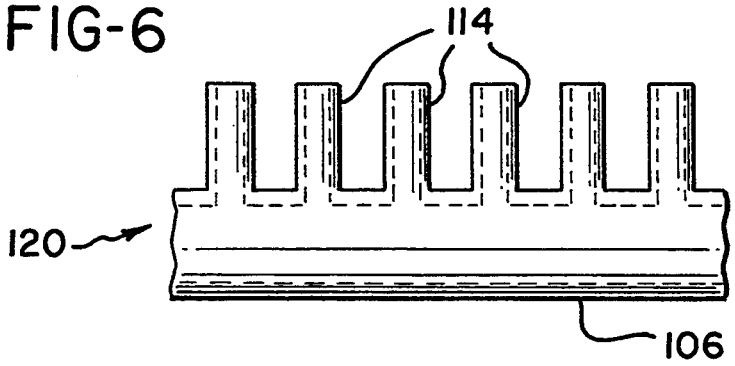

In the illustrated embodiment, the cores 110 do not enter into the passageways 118 such that some amount of blank material remains between the tubular risers 114 and the passageways 118. Accordingly, additional processing is necessary to complete a manifold 120, short sections of which are shown in FIGS. 5 and 6. In particular, the punch 112 and partially processed blank 106 are removed from the cavity 104.

The mandrels 116 are removed from the passageways 118 and second mandrel means comprising mandrels having holes 122, see FIG. 2, formed therein in substantial aligned with the tubular risers 114 when inserted into the passageways 118 are inserted into the passageways 118. The mandrels of the second mandrel means are substantially the same as the mandrels 116, except for the holes 122, and hence are illustrated by the dotted line holes 122 on the mandrels 116 of FIG. 2.

Figure 3:
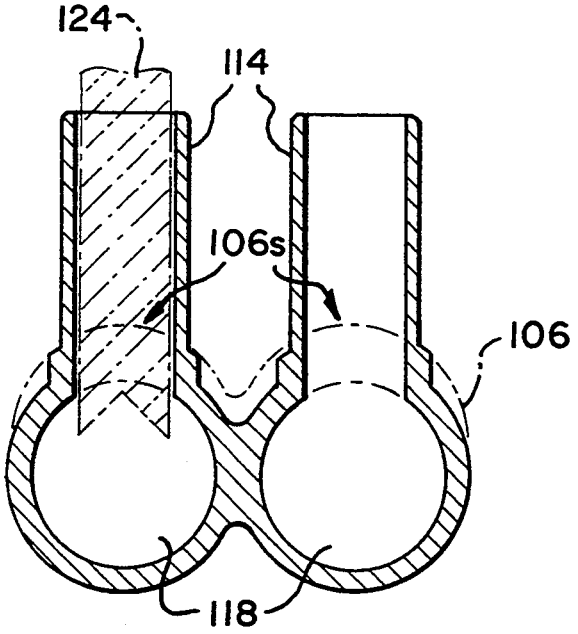
FIG. 3 is a sectional view of two risers extending from a completed manifold taken along the section line 3—3 of FIG. 5.

After the second mandrel means are inserted into the passageways 118, punch means, illustrated by a single dotted line punch 124 in FIG. 3, are forced into the tubular risers 114 to place the risers 114 into communication with the passageways 118. The punch means is then removed from the tubular risers 114 and the material removed by the punch means is removed from the blank 106 resulting in the manifold illustrated by the manifold sections of FIGS. 5 and 6. While use of the second mandrel means and the punch means is the currently preferred way of completing the manifold, it should be apparent that other methods can be used for this purpose.

While not necessary for the present invention, it is apparent that a portion **106*s* of the sidewall of the blank 106 is thicker than the remainder of the sidewall of the blank 106. As shown in FIG. 1, the thicker portion 106*s* of the sidewall of the blank 106 is positioned adjacent to the riser channels 108 prior to operation of the punch 112. In this way, the material which thickens the portion 106s of the sidewall of the blank 106 is used to form the risers 114** resulting in a manifold which has substantially uniform thickness sidewalls as shown in FIG. 3.

Figure 4:
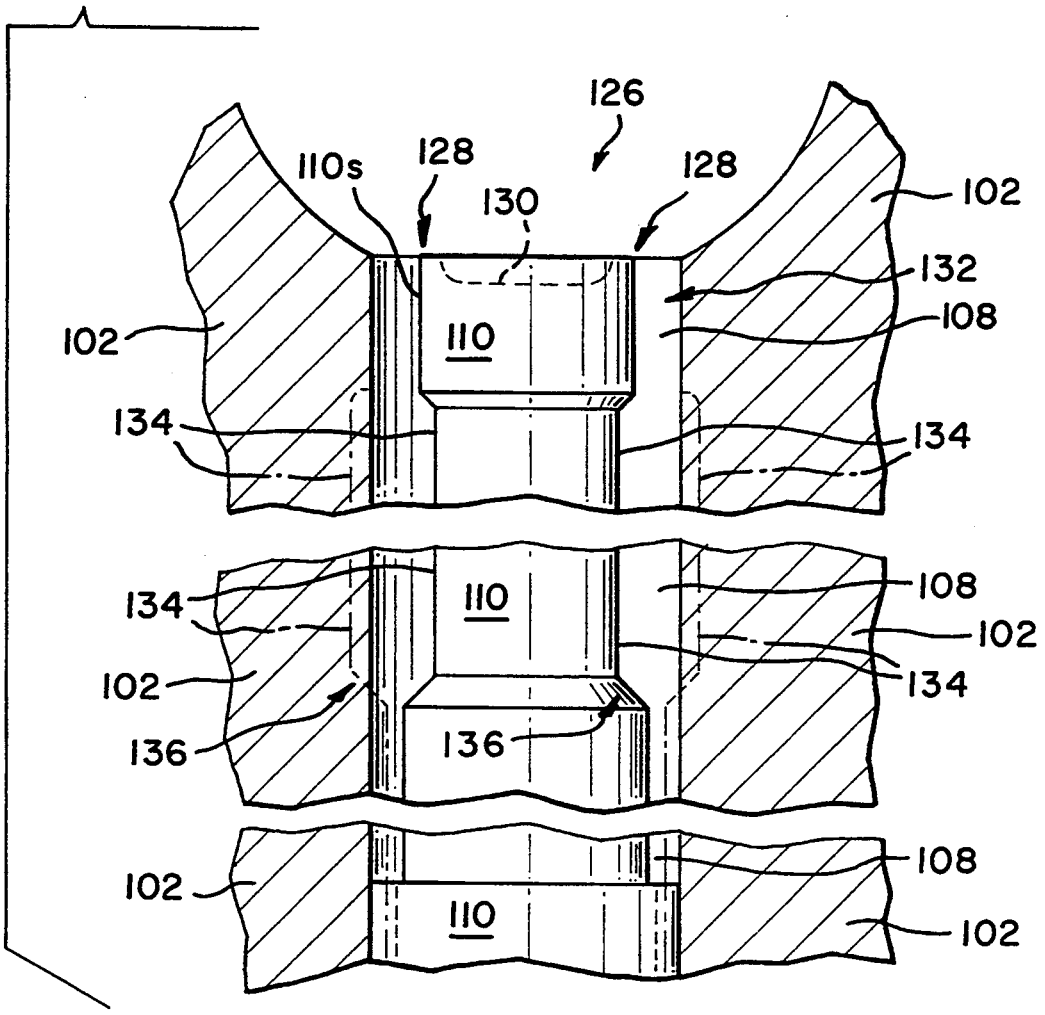
FIG. 4 is a sectional view on an expanded scale of one of the cores of FIG. 1.

FIG. 4 illustrates a preferred form of core for use in the present invention. Conventional punches or cores having a rounded or conical terminal or forming end tend to divide the material as it flows around a core. Instability in the material flow exerts lateral forces on the core which results uneven wall thickness in the tubular risers 114. Applicant has determined that a substantially square terminal or distal end 126 on the cores 110 which defines a sharp forming edge 128 between the distal end 126 and a forming surface 110s substantially eliminates the lateral forces and improves wall uniformity.

Figure 7:
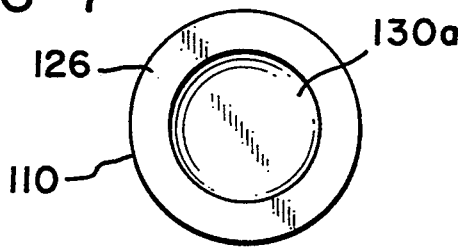
FIGS. 7–9 illustrate possible end-face configurations or indentations for the cores of FIG. 1.
Figure 8:
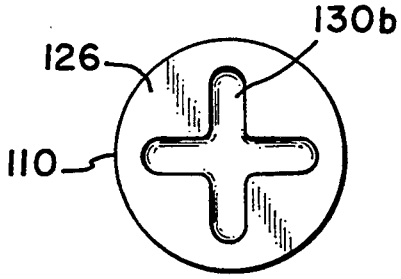
Figure 9:
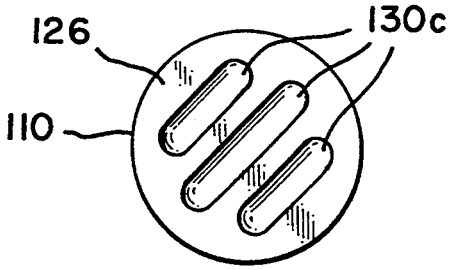

Applicant has also determined that forming a recess, depression, pattern of grooves, area of rough finish or the like to the distal ends 126 of the cores 110 tends to stabilize the material flowing immediately ahead of the cores 110 further improving uniformity in the sidewalls of the tubular risers 114. Examples of possible distal end indentations **130*a*, 130*b* and 130*c*** are shown in FIGS. 7–9.

As shown in FIG. 4, the cores 110 preferably include forming heads 132 with the remainder of the cores 110 and/or riser channels 108 being relieved, as shown by reference numeral 134, to facilitate removal of the risers 114 from the riser channels 108 and retention of lubricant. The riser channels 108 and/or cores 110 can be shaped to form defined distal ends on the tubular risers 114, as shown by the reference numeral 136. For example, a conical end can be formed on the inside or outside of the distal ends of the risers to facilitate insertion of tubes into the risers 114 or the risers 114 into the tubes to form a heat exchanger. Sufficient overflow space is provided beyond the distal end-forming structure of the riser channels 108 and/or the cores 110 to receive any additional material which may be forged from the blank 106 to prevent damage to the die 102 and punch 112.

Having thus described the methods and apparatus of the present invention in detail and by reference to preferred embodiments thereof, it will be apparent that modifications and variations are possible without departing from the scope of the invention defined in the appended claims.

What is claimed is:

1. Apparatus for forming at least one tubular riser on a blank comprising:

a die defining a cavity having a first portion for receiving said blank and at least one riser channel extending from said first portion;

core means positioned within said at least one riser channel for forming a hollow within said at least one tubular riser, said core means having a forming head on its distal end;

relief means extending along said core means beyond said forming head for facilitating removal of said at least one tubular riser from said at least one riser channel; and a punch received within said cavity for forging a portion of said blank into said at least one riser channel and around said core means to form said at least one tubular riser on said blank.

2. Apparatus for forming at least one tubular riser on a blank as claimed in claim 1 wherein said forming head includes a sharp forming edge located at the juncture between a surface on the terminal end of said forming head and a forming surface extending around said forming head adjacent its terminal end.

3. Apparatus for forming at least one tubular riser on a blank as claimed in claim 1 wherein said forming head includes a terminal surface having an indentation therein.

4. Apparatus for forming at least one tubular riser on a blank as claimed in claim 1 wherein said relief means comprises an enlarged extension of said at least one riser channel extending along at least a portion of said at least one riser channel from said forming head of said core means toward a proximal end of said core means.

5. Apparatus for forming at least one tubular riser on a blank as claimed in claim 1 wherein said relief means comprises a stepped down portion of said core means extending from said forming head toward a proximal end of said core means.

6. Apparatus for forming at least one tubular riser on a blank as claimed in claim 5 wherein said relief means further comprises an enlarged extension of said at least one riser channel extending along at least a portion of said at least one riser channel from said forming head of said core means toward said proximal end of said core means.

* * * * *